US005096196A

United States Patent [19]

Gutknecht et al.

[11] Patent Number: 5,096,196

[45] Date of Patent: Mar. 17, 1992

[54] GAMING APPARATUS

[76] Inventors: Leroy H. Gutknecht, 735 Oakmount #408; Michael A. Wichinsky, 2575 S. Highland Dr., both of Las Vegas, Nev. 89109

[21] Appl. No.: 500,878

[22] Filed: Mar. 29, 1990

[51] Int. Cl.[5] ..... A63F 9/00

[52] U.S. Cl. ..... 273/142 HA; 273/142 JA

[58] Field of Search ..... 273/142 H, 142 HA, 142 JC, 273/142 JD, 142 JA

[56] References Cited

U.S. PATENT DOCUMENTS

| | | | |
|---|---|---|---|
| 696,735 | 4/1902 | Heidinger | 273/142 JA |
| 2,283,583 | 5/1942 | Singer | 273/142 HA |
| 3,896,574 | 7/1975 | McNaney | 273/142 H |

FOREIGN PATENT DOCUMENTS

| | | | |
|---|---|---|---|
| 42020 | 3/1930 | Denmark | 273/142 HA |

*Primary Examiner*—Benjamin Layno

*Attorney, Agent, or Firm*—Jack C. Munro

[57] ABSTRACT

A gaming device which is designed to be utilized within a game of chance which utilizes a pair of rotating wheels which are mounted on the same rotational axis and which are mounted in juxtaposition to each other. The exterior face of each of the wheels includes a series of numbers. The wheels are to be rotated simultaneously in opposite directions and when rotation ceases, a certain aligned pair of numbers between the wheels will produce a winning value with therebeing multitudes of winning values depending upon which two numbers become aligned.

5 Claims, 1 Drawing Sheet 10
12
14
16
18
20
22
24
26
27
28
30
32
34
36
38
40
42
44
46
48
50
52
54
56
58
60
62
64
66
68
70
72
74
76
78
80
82
84
86
88
90
92
94
96
98
100
102
2

GAMING APPARATUS

BACKGROUND OF THE INVENTION

The field of this invention relates to gaming devices and more particularly to a gaming device which is intended to be utilized as a game of chance within a casino or other similar establishment.

Games of chance have long been known and utilized by human beings as a form of entertainment. The most common form of a game of chance as what is termed a "slot machine". A slot machine includes a plurality of rotating wheels which are to be randomly, individually, rotated. Inscribed on the exterior surface of the wheels is a series of indicia. Upon a certain transverse series of indicia aligning between the wheels, a certain winning value will be obtained.

SUMMARY OF THE INVENTION

The structure of the present invention is directed to a gaming device which uses a pair of sheet material wheels rotatably mounted on the same rotational axis. The outer face, or exterior surface, of each of the wheels is inscribed with a series of numbers with the numbers on each wheel being the same. The outer wheel of the pair of wheels is smaller in diameter than the inner wheel. When observing the exterior surface of both wheels, a series of numbers on both the wheels can be readily observed with each series being concentric to each other. A motor arrangement is provided which is to cause rotation of both wheels in opposite rotational directions. Rotation of the wheels is to be accomplished simultaneously. Upon the wheels ceasing rotation, if a certain pair of numbers align in a particular location, a winning value will be obtained. It is to be understood that there will be a multitude of different winning values depending on which two numbers become aligned.

The primary objective of the present invention is to construct a game of chance which utilizes a pair of observable rotating flat wheels which are used to obtain a winning value, such a game of chance being substantially different from conventional games of chance.

DETAILED DESCRIPTION OF THE SHOWN EMBODIMENT

Figures 1, 2:
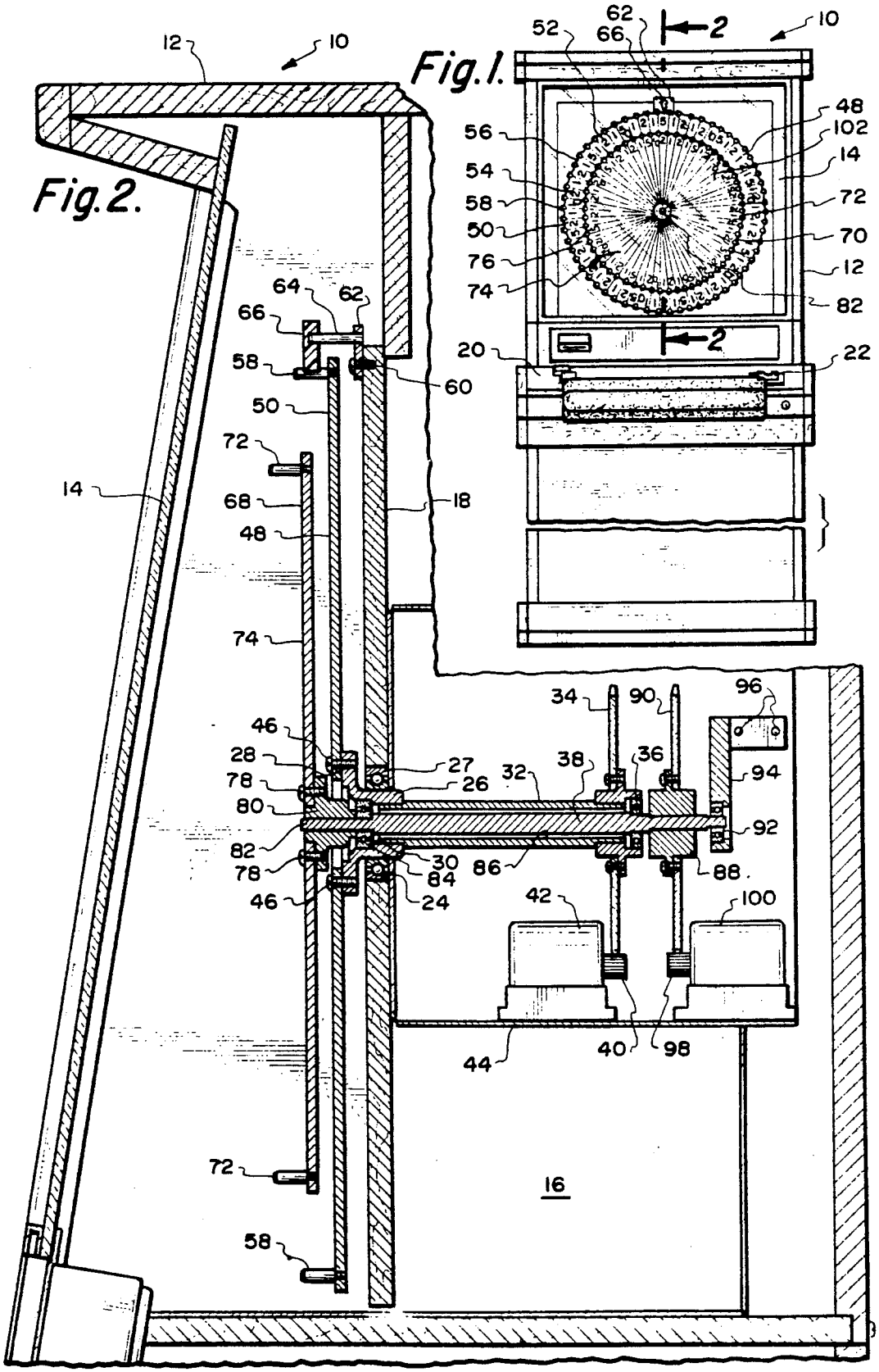
FIG. 1 is a front view of the gaming apparatus of the present invention.
FIG. 2 is a cross-sectional view taken along line 2—2 of FIG. 1.

Referring particularly to the drawing, there is shown a gaming apparatus 10 of this invention which is formed of a housing 12. The housing 12 is basically in the form of a cabinet and may be constructed of wood, plastic or other similar type of construction material. Included within the housing 12 is a front inclined enclosing face which is transparent and which is defined as a window 14. Interiorly of the window 14 and the housing 12 there is defined an internal chamber 16. This internal chamber 16 is divided by a divider wall 18.

The housing 12 also includes a ledge 20. On the ledge 20 are to be located a series of selector buttons (not shown). The purpose of the selector buttons is to vary the odds of playing. Also included within housing 12 is a coin slot 22 as well as a start button (not shown).

The divider walls 18 includes a through hole 24. Rotationally mounted by bearing 27 within the hole 24 is a cup-shaped member 26. Bearing 27 is mounted in wall 18. Cup-shaped member 26 is integrally connected to an outwardly flared flange 28. The cup-shaped member 26 includes a centrally disposed through opening 30. Fixedly secured to the backside of the cup-shaped member 26 is a hollow shaft 32. The outer end of the hollow shaft 32 is centrally fixedly connected to a driven gear 34. The driven gear 34 is rotationally mounted by means of a bearing 36 on a shaft 38. The driven gear 34 is in continuous engagement with a drive gear 40. Drive gear 40 is rotationally operated by means of a electrically operated motor 42. Motor 42 is shown mounted on a support platform 44 mounted within the internal chamber 16.

Fixedly mounted onto the flange 28 by means of bolts 46 is a sheet material wheel 48. Wheel 48 is preferably located along a vertical plane. However, the wheel 48 could be located horizontal or in any other inclined orientation therebetween. Material of construction of the wheel 48 will normally be wood, plastic or metal. The wheel 48 has an exterior surface defined as a front face 50. Inscribed within the front face 50 directly adjacent the periphery of the wheel 48 is a series of indicia in the form of a plurality of numbers 52. The numbers 52 shown are "1, 2, 5, 10, 20, and 50". Each individual number 52 is located within a prescribed area defined as a segment 54. The number of segments could be increased or decreased, but a desirable quantity of such segments would be approximately sixty. The peripheral surface of the wheel 48 includes a series of recesses 56 with therebeing a single recess for each segment 54. Mounted within the wheel 48 at the point joining of each directly adjacent pair of recesses 56 is a pin 58. It is to be understood that there is in essence a pair of pins 58 on each side of each recess 56. The pins 58 are evenly spaced apart. Each pin 58 protrudes outwardly toward the window 14 a short distance such as approximately one inch.

Fixedly mounted by a fastener 60 to the wall 18 is a support plate 62. A pin 64 is mounted on the support plate 62. Pivotally mounted on the outer end of the pin 64 is a flapper member 66. When the wheel 48 is rotated, flapper member 66 pivots by being contacted by each of the pins 58. This contact produces a clicking sound and to the human being operator of the gaming apparatus 10 is a desirable sound giving the opinion that the flapper member 66 is causing the wheel 48 to cease rotation. In actuality, flapper member 66 has nothing to do with the ceasing the rotation of the wheel 48. However, the flapper member 66 is aligned with the specific desired location which determines the winning value at the end of each rotation.

Located between the wheel 48 and the window 14 is a second wheel 68. The peripheral surface of the second wheel 68 also includes a series of recesses 70 which are similar to recesses 56. Separating each directly adjacent pair of recesses 70 are pins 72. These pins 72 are not to come into contact with any form of a flapper member 66. It is to be noted that the diameter of the second wheel 68 is somewhat less than the diameter of the wheel 48. Inscribed within the exterior surface, or front face 74, is indicia in the form of a series of numbers 76. These numbers 76 are the same as numbers 52 and are actually oriented in precisely the same manner.

The wheel 68 is fixedly mounted by bolts 78 to a mounting member 80. Fixedly mounted within the center of the mounting member 80 is a smaller diametered extension 82 of the shaft 38. Between a portion of the extension 82 and the inner wall of the cup-shaped member 26 is a bearing 84. The shaft 38 is located within the hollow through opening 86 of the shaft 32. The portion of the shaft 38 that extends exteriorly of the bearing 36 is fixedly mounted within hub 88 of a driven gear 90. The portion of the shaft 38 that extends exteriorly of hub 88 is supported by a bearing 92 on a plate 94. Plate 94 is fixedly mounted by conventional fasteners 96 to a portion of the housing 12. The driven gear 90 is in continuous operative engagement with a drive gear 98. Drive gear 98 is to be rotationally driven by a motor 100.

The operation of the gaming apparatus 10 of this invention is as follows: A human being operator is to place a coin within coin slot 22. Upon selecting of the particular selected odds by buttons (not shown) and activating of the start button (not shown), both motors 42 and 100 are activated simultaneously. As a result, driven gears 34 and 90 are simultaneously driven in opposite directions. Rotation of driven gear 90 rotates shaft 38 which in turn rotates wheel 68. Rotation of driven gear 34 rotates shaft 32 which rotates cup-member 26, flange 28, and wheel 48.

After a random number of rotations of both wheels 48 and 68 the wheels will cease rotation. At the end of rotation, the wheels 48 and 68 will be caused to cease rotation so that only a pair of the segments 54 for wheel 48 and segment 102 for wheel 68 will be positioned to be in alignment with flapper member 66. These numbers are to be read by a readout device (not shown). If a pair of "1's" are aligned, a certain winning value will be produced. If a pair of "2's" are aligned, another winning value will be produced. The same is true for a pair of 5's, 10's, 20's and 50's. It is to be understood that because there are a lot more 1's on the wheels 48 and 68, the chance of getting an aligned pair of 1's is substantially greater than any other aligned series of numbers. The chance of getting an aligned pair of numerical value of "50" is exceedingly remote.

It is to be considered to be within the scope of this invention that the wheels 48 and 68 could be represented in video form rather than in actual form. In the video form, the wheels would appear to rotate together in the same manner as in the actual form.

What is claimed:

1. A gaming apparatus comprising:

a first wheel having a first rotational axis, a first shaft mounted on said first wheel with the rotational axis of said first shaft coinciding with said first rotational axis, a first motor connected to said first shaft, said first motor to cause rotation of said first shaft and said first wheel, said first wheel having a first exterior surface, first indicia formed on said first exterior surface, said first indicia defining a multitude of different values;

a second wheel having a second rotational axis, a second shaft mounted on said second wheel with the rotational axis of said second shaft coinciding with said second rotational axis, a second motor connected to said second shaft, said second motor to cause rotation of said second shaft and said second wheel, said second wheel having a second exterior surface, second indicia formed on said second exterior surface, said second indicia defining a multitude of different values, said second wheel being located directly adjacent said first wheel, whereby both said first wheel and said second wheel are to be rotated and upon ceasing rotation an aligned segment of said first and second indicia at a specific location is to be capable of producing a winning value with different winning values assigned for different segments of said first and second indicias; and said first wheel being formed of sheet material, said second wheel being formed of sheet material, said first wheel having a first diameter, said second wheel having a second diameter, said second diameter being smaller than said first diameter.

2. A gaming apparatus comprising:

a first wheel having a first rotational axis, a first shaft mounted on said first wheel with the rotational axis of said first shaft coinciding with said first rotational axis, a first motor connected to said first shaft, said first motor to cause rotation of said first shaft and said first wheel, said first wheel having a first exterior surface, first indicia formed on said first exterior surface, said first indicia defining a multitude of different values;

a second wheel having a second rotational axis, a second shaft mounted on said second wheel with the rotational axis of said second shaft coinciding with said second rotational axis, a second motor connected to said second shaft, said second motor to cause rotation of said second shaft and said second wheel, said second wheel having a second exterior surface, second indicia formed on said second exterior surface, said second indicia defining a multitude of different values, said second wheel being located directly adjacent said first wheel, whereby both said first wheel and said second wheel are to be rotated and upon ceasing rotation an aligned segment of said first and second indicia at a specific location is to be capable of producing a winning value with different winning values assigned for different segments of said first and second indicias; and said first indicia comprising a plurality of different numbers, said second indicia comprising a plurality of different numbers, said numbers of said first and second indicias being the same.

3. A gaming apparatus comprising:

a first wheel having a first rotational axis, a first shaft mounted on said first wheel with the rotational axis of said first shaft coinciding with said first rotational axis, a first motor connected to said first shaft, said first motor to cause rotation of said first shaft and said first wheel, said first wheel having a first exterior surface, first indicia formed on said first exterior surface, said first indicia defining a multitude of different values;

a second wheel having a second rotational axis, a second shaft mounted on said second wheel with the rotational axis of said second shaft coinciding with said second rotational axis, a second motor connected to said second shaft, said second motor to cause rotation of said second shaft and said second wheel, said second wheel having a second exterior surface, second indicia formed on said second exterior surface, said second indicia defining a multitude of different values, said second wheel being located directly adjacent said first wheel, whereby both said first wheel and said second wheel are to be rotated and upon ceasing rotation an aligned segment of said first and second indicia at a specific location is to be capable of producing a winning value with different winning values assigned for different segments of said first and second indicias;

during rotation of both said first wheel and said second wheel, both said first motor and said second motor to be operated simultaneously which will result in simultaneous rotation of said first wheel and said second wheel;

said second wheel being located directly adjacent said first exterior surface but spaced therefrom;

the rotation of said second wheel being in a direction opposite to the rotation of said first wheel; and said second rotational axis coinciding with said first rotational axis.

4. The gaming apparatus as defined in claim 3 wherein:

said first indicia comprising a plurality of different numbers, said second indicia comprising a plurality of different numbers, said numbers of said first and second indicias being the same.

5. The gaming apparatus as defined in claim 4 wherein:

said first wheel having a first peripheral edge, said second wheel having a second peripheral edge, said first indicia being located directly adjacent said first peripheral edge, said second indicia being located directly adjacent said second peripheral edge;

said first exterior surface of said first wheel being located in a vertical plane, said second exterior surface of said second wheel being located in a vertical plane; and said first wheel being formed of sheet material, said second wheel being formed of sheet material, said first wheel having a first diameter, said second wheel having a second diameter, said second diameter being smaller than said first diameter.

* * * * *